US005339131A

United States Patent [19]

Rosenburgh et al.

[11] Patent Number: 5,339,131

[45] Date of Patent: Aug. 16, 1994

[54] AUTOMATIC REPLENISHMENT, CALIBRATION AND METERING SYSTEM FOR A PHOTOGRAPHIC PROCESSING APPARATUS

[75] Inventors: John H. Rosenburgh, Hilton; Robert L. Horton, Rochester; David L. Patton, Webster, all of N.Y.

[73] Assignee: Eastman Kodak Company, Rochester, N.Y.

[21] Appl. No.: 56,455

[22] Filed: May 3, 1993

[51] Int. Cl.[5] ..... G03D 3/02

[52] U.S. Cl. ..... 354/324

[58] Field of Search ..... 354/324, 331, 336; 134/64 P, 64 R, 122 P

[56] References Cited

U.S. PATENT DOCUMENTS

| | | | |
|---|---|---|---|
| Re. 30,123 | 10/1979 | Crowell | 137/624 |
| Re. 31,484 | 1/1984 | Melander | 354/324 |
| 3,529,529 | 9/1970 | Schumacher | 95/89 |
| 3,554,107 | 1/1971 | McCarthy | 95/89 |
| 3,787,689 | 1/1974 | Fidelman | 250/219 |
| 3,822,723 | 7/1974 | Crowell | 137/624 |
| 3,990,088 | 11/1976 | Takita | 354/298 |
| 4,128,325 | 12/1978 | Melander | 354/298 |
| 4,134,663 | 1/1979 | Laar | 354/298 |
| 4,231,723 | 11/1980 | Spuhl | 417/429 |
| 4,293,211 | 10/1981 | Kaufmann | 354/298 |
| 4,314,753 | 2/1982 | Kaufmann | 354/321 |
| 4,372,665 | 2/1983 | Kaufmann | 354/298 |
| 4,466,072 | 8/1984 | Kaufmann | 364/502 |
| 4,480,901 | 11/1984 | Osegowitsch et al. | 354/298 X |
| 4,577,950 | 3/1986 | Mackson | 354/324 |
| 4,603,956 | 8/1986 | Baker | 354/298 |
| 4,769,662 | 9/1988 | Suzuki | 354/324 |
| 4,905,161 | 2/1990 | Miller | 364/510 |
| 4,961,516 | 10/1990 | Nakamura | 222/94 |
| 4,977,067 | 12/1990 | Yoshikawa | 430/398 |
| 4,985,320 | 1/1991 | Griffin | 430/30 |
| 4,999,660 | 3/1991 | Wright | 354/324 |
| 5,025,279 | 6/1991 | Ellsworth | 354/298 |
| 5,053,796 | 10/1991 | Ohba | 354/322 |
| 5,066,570 | 11/1991 | Nakamura et al. | 354/322 |
| 5,189,456 | 2/1993 | Sherburne et al. | 354/298 |

*Primary Examiner*—D. Rutledge

*Attorney, Agent, or Firm*—Frank Pincelli

[57] ABSTRACT

A low volume photographic material processing apparatus that utilizes a tank having integral means through which processing solution is pumped and a rack which has integral means to facilitate its insertion and removal from the tank, the rack and the tank are relatively dimensioned so that a small volume for holding processing solution and photosensitive material is formed between the rack and the tank. The apparatus accurately maintains the processing solution level by keeping the upper surface of the processing solution below the high impingement devices solution exit.

19 Claims, 2 Drawing Sheets

AUTOMATIC REPLENISHMENT, CALIBRATION AND METERING SYSTEM FOR A PHOTOGRAPHIC PROCESSING APPARATUS

CROSS REFERENCE TO RELATED APPLICATIONS

Reference is made to commonly assigned copending patent applications: Ser. No. 844,820 entitled "A DRIVING MECHANISM FOR A PHOTOGRAPHIC PROCESSING APPARATUS" filed Mar. 2, 1992 in the names of Ralph L. Piccinino, Jr., David L. Patton, Roger E. Bartell, Anthony Earle, and John Rosenburgh, Ser. No. 844,343 entitled "ANTI-WEB ADHERING CONTOUR SURFACE FOR A PHOTOGRAPHIC PROCESSING APPARATUS" filed Mar. 2, 1992 in the names of Roger E. Bartell, Ralph L. Piccinino, Jr., John H. Rosenburgh, Anthony Earle, and David L. Patton, Ser. No. 844,355 entitled "A SLOT IMPINGEMENT FOR A PHOTOGRAPHIC PROCESSING APPARATUS" filed Mar. 2, 1992 in the names of John Rosenburgh, David L. Patton, Ralph L. Piccinino, Jr., and Anthony Earle, Ser. No. 844,815 entitled "A RACK AND A TANK FOR A PHOTOGRAPHIC PROCESSING APPARATUS filed Mar. 2, 1992 in the names of David L. Patton, Roger E. Bartell, John H. Rosenburgh and Ralph L. Piccinino, Jr. and Ser. No. 855,806 entitled "RECIRCULATION, REPLENISHMENT, REFRESH, RECHARGE AND BACKFLUSH FOR A PHOTOGRAPHIC PROCESSING APPARATUS" filed Mar. 2, 1992 in the names of Roger E. Bartell, David L. Patton, John Rosenburgh, and Ralph L. Piccinino, Jr.; Ser. No. 020,281 entitled "A Rack AND A TANK FOR A PHOTOGRAPHIC LOW VOLUME THIN TANK INSERT FOR A RACK AND A TANK PHOTOGRAPHIC PROCESSING APPARATUS filed Feb. 19, 1993 in the names of David L. Patton and John H. Rosenburgh; and Ser. No. 08/056,730 entitled "AUTOMATIC REPLENISHMENT, CALIBRATION AND METERING SYSTEM FOR AN AUTOMATIC TRAY PROCESSOR" filed herewith in the names of John Rosenburgh, Robert L. Horton, David L. Patton and Ralph L. Piccinino, Jr..

FIELD OF THE INVENTION

The invention relates to the field of photography, and particularly to a photosensitive material processing apparatus.

BACKGROUND OF THE INVENTION

The processing of photosensitive material involves a series of steps such as developing, bleaching, fixing, washing, and drying. These steps lend themselves to mechanization by conveying a continuous web of film or cut sheets of film or photographic paper sequentially through a series of stations or tanks, each one containing a different processing liquid appropriate to the process step at that station.

There are various sizes of photographic film processing apparatus, i.e., large photofinishing apparatus and microlabs. A large photofinishing apparatus utilizes tanks that contain approximately 100 liters of each processing solution. A small photofinishing apparatus or microlab utilizes tanks that may contain less than 10 liters of processing solution.

The chemicals contained in the processing solution: cost money to purchase; change in activity; and are seasoned by the constituents of the photosensitive material that leach out during the photographic process; and after the chemicals are used the chemicals must be disposed of in an environmentally safe manner. Thus, it is important in all sizes of photofinishing apparatus to reduce the volume of processing solution. The prior art suggest various types of replenishing systems that add or subtract specific chemicals to the processing solution to maintain a consistency of photographic characteristics in the material developed. Photosensitive material processing equipment typically consists of several large volume tanks of processing solution that the exposed photosensitive material is driven or towed through to produce an image, as the photosensitive material is processed the strength of the processing solutions is diminished and will eventually become exhausted. To prevent the continual weakening of the processing solution additional fresh processing solution is added to the tank solution at a rate equivalent to the rate of use and rate of carry out of the processing solution. The above maintains processing solution activity and volume. Typically the replenish is very small compared to the working processing tank volume. A typical ratio of replenishment per square foot of photosensitive material for a large volume tank would be 0.00025 to 0.00075 of the tank volume. Since the above ratio is small the effect of pulsing delivery and cyclic variation of the replenishment delivery by 5 or 10% over time, does not have an immediate significant effect on the processing solution.

Typical replenishment is accomplished by using a single standard bellow pump (like Gorman-Rupp single bellow metering pump mode number 13300-007). When replenishment is required the pump is turned on/off through known means and the replenishment solution is pumped in "doses" or "squirts" usually into the top of the main processing tank in close proximity to the recirculation system. As the bellows pumps delivers solution to the top of the tank, the bellows pumps are not experiencing any variable back pressure or head. As the replenishment in the large tank occurs, the pressure is only that of line restriction and gravity from the replenishment storage tanks to the solution delivery location. The pulsing delivery is acceptable as the ratio of replenishment to tank solution is very small. The above pump works well for large volume tanks, because the large volume of solution acts as a ballast.

Replenishment calibration is typically a manual operation involving running the replenishment pump and measuring the solution output volume. This measuring device used is most often a graduated cylinder. The measured amount of solution is compared to the chemical manufacturers' specification for the type of photosensitive material and amount of replenishment solution required to be added.

Successive timed measurements of replenishment solution delivery are made to determine the actual replenishment solution delivery rate. If adjustments are required, a manual adjustment of the bellows pump is made. Following the adjustment, the delivery of replenishment solution is again measured, and further adjustments are made until the delivery of replenishment solution is consistently at the required amount. During the above adjustment time, the processor can not be used to process photosensitive materials. Thus, the processor would not be processing photosensitive materials when the pumps are being calibrated.

Problems To Be Solved By The Invention

The prior art utilized is a manual time consuming procedure, requiring an experienced operator to measure the replenishment delivery amounts prior to and following each calibration and adjustment of the replenishment pumps.

Typically the calibration and adjustment of the pumps can take 30 minutes to 4 hours. Furthermore, the calibration and adjustments are subject to human error. If the accuracy of the processor is not maintained then the processor will not produce products having consistent quality.

As the tank volumes are reduced, the ratio of replenisher delivery to tank volume significantly increased for example by a factor of 10 for a tank one tenth the volume of a standard 20 liter tank. Because the tank volume is small, the "pulse" or "squirt" delivery of the bellows pump has a greater impact on the tank solution consistency. This pulsing delivery creates pulsing or cyclic activity increases and decreases in the processor as its volume percentage is greater in the lower volume tank.

The consistency of replenishment solution delivery is also more critical in smaller processing volumes.

Another problem in the prior art is that when the pumps are turned on the rotational position of the pump varies. Similarly when the pumps are turned off the pump drive motor coasts stopping rotation at an unknown position. The above causes a variation of replenishment solution delivery over a constant time interval when the pumps are activated.

SUMMARY OF THE INVENTION

This invention overcomes the disadvantages of the prior art by providing a replenishment pump calibration system that is integrated into the processor so that no manual measurement or special tools are required to set replenishment solution rates. As this is an integrated operation it can be done very quickly and accurately without requiring an experienced operator and excessive down time.

By combining two or more bellows pumps together in parallel and equally offsetting the replenishment solution delivery cycle of each bellows pump, the "pulsing" may be smoothed to a more consistent solution delivery rate per rotation of the pump drive motor. A stepper motor may be used to drive the bellows pumps. Small delivery changes may be made by simply changing the stepper motor drive frequency. The pump drive frequency is directly proportional to the replenishment solution delivered. This allows the start and stop rotational position of the bellows pumps to be known. By combining the aforementioned bellows pumps and stepper motor with a constant metering vessel and control system automatic replenishment calibration may be achieved. A single bellows pumps may be connected to a stepper motor with variable rotational speed such that the time for filling of the bellows is minimized and the time for emptying the bellows is maximized. Therefore the speed of the pump may be varied during the 360° rotation to provide a smooth nonpulsing delivery of the replenished solution.

The foregoing is accomplished by providing a rack and a tank apparatus for processing photosensitive materials, in which processing solution flows through a rack and a tank, the rack and the tank are relatively dimensioned so that a volume for holding and moving processing solution and photosensitive material is formed, said apparatus characterized by: means for replenishing the processing solution in precisely controlled volumes, in order to uniformly distribute the replenished solution.

Advantageous Effect of the Invention

The above arrangement, provides a method for accurately replenishing processing solution through a low volume photographic material processing apparatus.

This invention also permits start up and shut down of the of the replenishment pumps, while allowing the processor to produce products having consistent quality.

Another advantage of this invention is that the calibration of the replenishment pumps requires minimal human intervention. Thus, reducing operation error.

An additional advantage of the replenishment system is that the photographic processor may remain in operation while the replenishment system is being calibrated, checked or different solution replenishment rates are implemented.

DESCRIPTION OF THE PREFERRED EMBODIMENT

Figure 1:
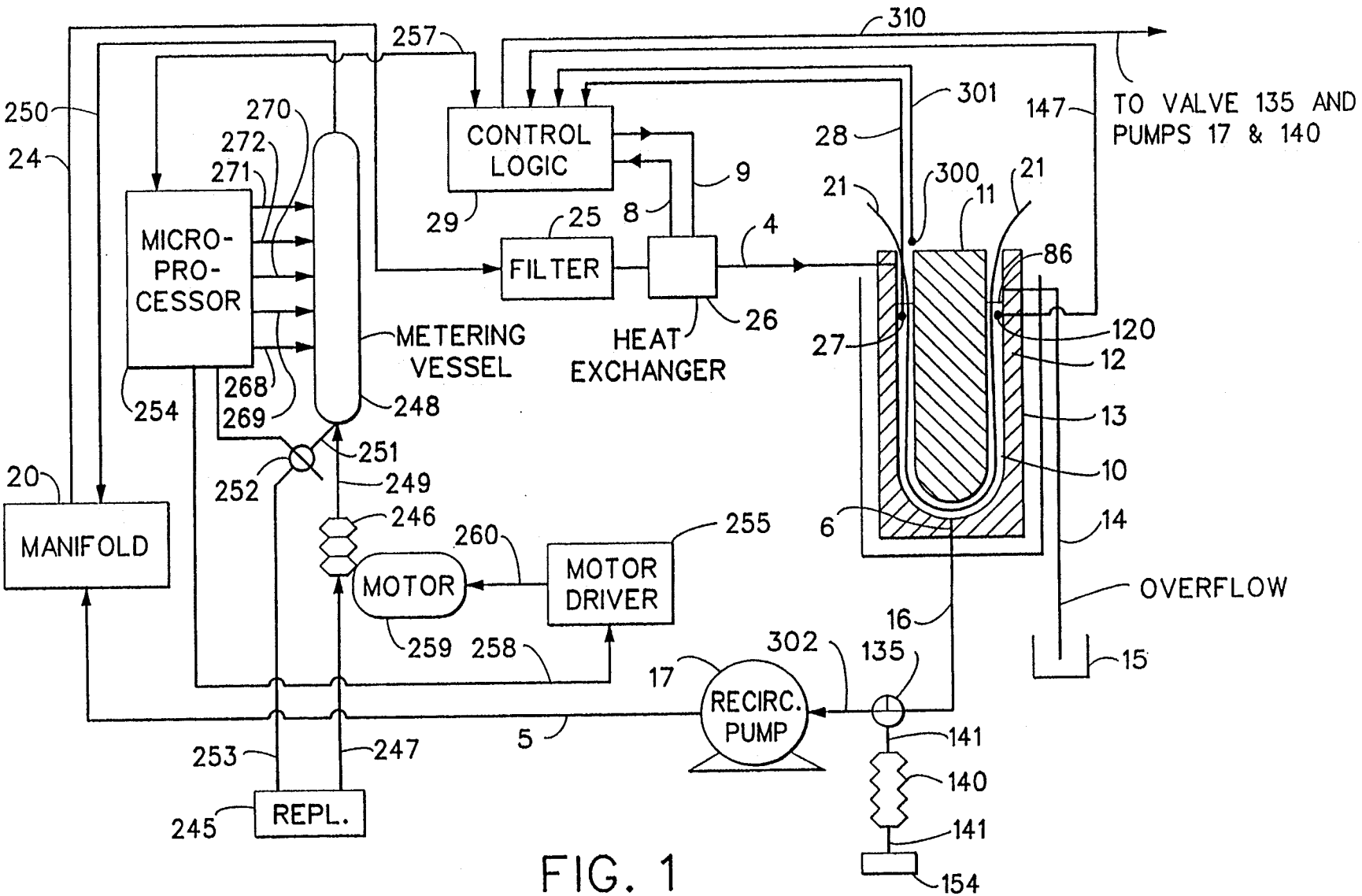
FIG. 1 is a schematic drawing of the processing solution recirculation replenishment and calibration system of the apparatus of this invention.

Referring now to the drawings in detail, and more particularly to FIG. 1, the reference character 11 represents a rack, which may be easily inserted and removed from tank 12. Rack 11 and tank 12 form a low volume photosensitive material processing vessel 13.

When rack 11 is inserted in tank 12, a space 10 is formed. Rack 11 and tank 12 are designed in a manner to minimize the volume of space 10. The outlet 6 of vessel 13 is connected to recirculating pump 17 via conduit 16. Recirculating pump 17 is coupled to manifold 20 via conduit 5 and manifold 20 is coupled to filter 25 via conduit 24. Filter 25 is connected to heat exchanger 26 and heat exchanger 26 is connected to space 10 via conduit 4. Heat exchanger 26 is also connected to control logic 29 via wire 9. Control logic 29 is connected to heat exchanger 26 via wire 8 and sensor 27 is connected to control logic 29 via wire 28. Overflow sensor 120 is connected to logic 29 via wire 147. Solution replenishment vessel 245 is connected to metering pump 246 via conduit 247. Metering pump 246 is connected to metering vessel 248 via conduit 249. Metering vessel 248 is connected to manifold 20 via conduit 250. Metering vessel 248 is connected to replenishment vessel 245 via conduit 251, valve 252 and conduit 253. Metering pump 246, metering vessel 248, valve 252 and motor drive 255 are connected to microprocessor 254.

The photographic processing chemicals that comprise the photographic solution are placed in replenishment vessel 245. The desired replenishment rate is entered into control logic 29 by any known means such as manually or scanning the desired information through the control panel of control logic 9. Metering pump 246 and metering vessel 248 are used to place the correct amount of chemicals in manifold 20, when photosensitive material sensor 300 senses that material 21 is entering space 10. Sensor 300 transmits a signal to control logic 29 via line 301. Control logic 29 sends a signal via wire 257 to microprocessor 254. Microprocessor 254 transmits a signal via wire 258 to motor driver 255. Motor 259 is the B & B Motor Corp., motor model No. BV6G-60 and motor driver 255 is the B & B gear motor driver No. C-10PN-4. Motor 259 and motor driver 255 are manufactured by B & B Motor And Control Corp. of Apple Hill Commons, Burlington, Conn. 06013. Microprocessor 254 is the Intel 8051 Microcontroller manufactured by Intell Corp. of 3065Bowers Avenue, Santa Clara, Calif. 95051. Motor driver 259 transmits a signal to motor 259 via wire 260. Motor 259 may be a stepper motor or a motor that may be controlled to a variable speed. The above signal energizes motor 259 which causes replenishment solution to be pumped from replenishment vessel 245 through conduit 247 into pump 246. Pump 246 is a single bellows pump with 360° rotational speed whose speed can be varied during the 360° rotation to provide smooth nonpulsing solution output or pump 246 is a combination of two or more bellows pumps that are connected together equally out of rotational phase with their input and output lines connected in parallel so that the solution delivery is smoothed to a more consistent solution delivery rate per rotation of the pump drive motor. Pump 246 pumps solution through conduit 249 into metering vessel 248. Thereupon the replenishment solution moves through conduit 250 into manifold 64. At start up of vessel 13 or when replenishment calibration is initiated, valve 252 is opened which drains the contents of metering vessel 248 through conduit 253 into replenisher vessel 245. Valve 252 is then closed, microprocessor 254 signals motor driver 255 which starts motor 259 at a constant rate driving pump 246. Replenisher solution is pumped from replenisher vessel 245 via conduit 247 into metering vessel 248 via conduit 249 by pump 246. As the solution is pumped through metering vessel 248 the solution passes sensors 268, 269, 270, 271 and 272. Sensors 268–272 are used to sense the rate of solution flow through metering vessel 248. As metering vessel 248 is a constant volume vessel the replenishment rate may be determined by microprocessor 254.

The rate measured by sensors 268–272 is compared to the desired replenishment rate inputted into control logic 29 and transmitted to microprocessor 254. Microprocessor 254 signals motor driver 255 to speed up or slow down motor 259 as required to meet replenishment rate requirements. Manifold 20 introduces the photographic processing solution into conduit 24.

The photographic processing solution flows into filter 25 via conduit 24. Filter 25 removes contaminants and debris that may be contained in the photographic processing solution. After the photographic processing solution has been filtered, the solution enters heat exchanger 26.

Sensor 120 senses the solution level 86 and sensor 27 senses the temperature of the solution and respectively transmits the solution level and temperature of the solution to control logic 29 via wires 147 and 28 respectively. For example, control logic 29 contains the series CN 310 solid state temperature controller manufactured by Omega Engineering, Inc. of 1 Omega Drive, Stamford, Conn. 06907, and Intel 8051 Microcontrollers. Logic 29 compares the solution temperature sensed by sensor 27 and the temperature that exchanger 26 transmitted to logic 29 via wire 9. Logic 29 will inform exchanger 26 to add or remove heat from the solution. Thus, logic 29 and heat exchanger 26 modify the temperature of the solution and maintain the solution temperature at the desired level.

Sensor 120 senses the solution level in space 10 and transmits the sensed solution level to control logic 29 via wire 147. Logic 29 compares the solution level sensed by sensor 120 via wire 147 to the solution level set in logic 29. Logic 29 will inform valve 135 and pump 140 via line 310 to add additional processing solution from tank 154 through conduit 141 into pump 140. Thereupon, pumps 140 will transmit solution into conduit 302 via conduit 141 and valve 135. Once the solution level is at the desired set point control logic 29 will inform pump 140 and valve 135 to stop adding additional solution.

When vessel 13 contains too much solution the excess solution will be removed by drain 14 and flow into reservoir 15.

Figure 2:
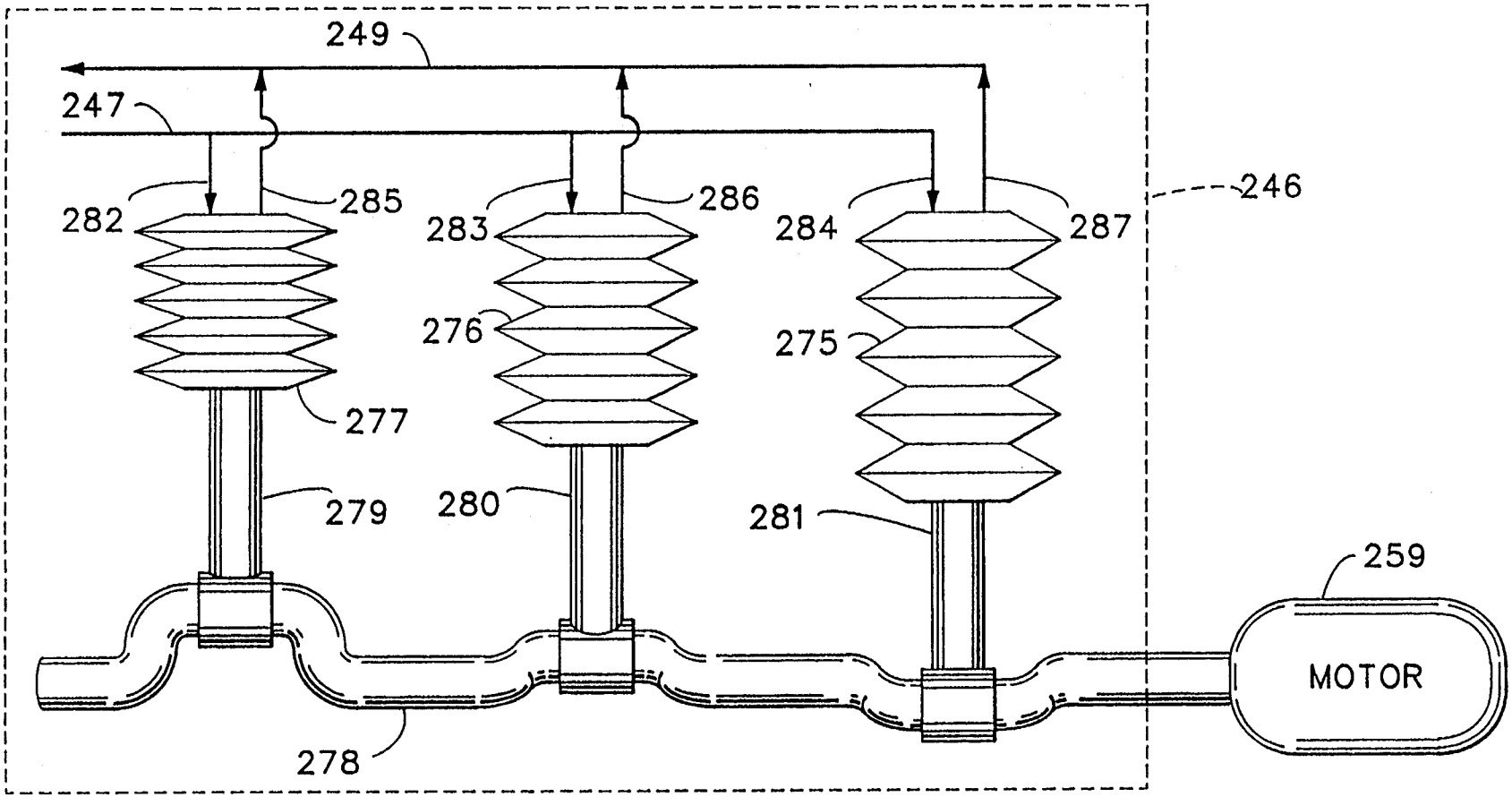
FIG. 2 is a drawing of pump 246.

FIG. 2 is a drawing of pump 246. Pump 246 comprises bellows 275, 276 and 277, crank shaft 278 and connecting rods 279, 280 and 281. Shaft 278 is respectively connected to bellows 275, 276 and 277 by connecting rods 281, 280 and 279. Connecting rods 279, 280 and 281 are interconnected to shaft 278, 120° out of rotational phase with each other. One skilled in the art would realize that other pumps or devices may be used in place of or in combination with bellows pumps, i.e., piston pumps and peristaltic pumps, etc. Also the rotational speed of a single bellows pump may be varied during each rotational cycle to smooth out or reduce the pulsing delivery of the replenished solution. When pump drive motor 259 is energized shaft 278 will rotate and connecting rods 279, 280 and 281 will alternately compress and expand bellows pumps 275, 276 and 277. Thereupon drawing replenishment solution through conduit 247 and forcing replenishment solution out through conduit 249. Pump inlets 282, 283 and 284 are connected to replenishment vessel 245 (FIG. 1) via conduit 247. Outlets 285, 286 and 287 are connected to metering vessel 248 via conduit 249.

The above specification describes a new and improved apparatus for processing photosensitive materials. It is realized that the above description may indicate to those skilled in the art additional ways in which the principles of this invention may be used without departing from the spirit. It is, therefore, intended that this invention be limited only by the scope of the appended claims.

Parts List

4 conduit
6 outlet
7 conduit wire
10 space
11 rack
12 tank
13 vessel
15 reservoir
16 conduit
17 pump
20 manifold
21 material
24 conduit
25 filter
26 heat exchanger
27 sensor
28 wire
29 control logic
64 manifold 86 heat exchanger
120 overflow sensor
135 valve
147 wire
245 vessel
246 pump
247 conduit
248 vessel
249 conduit
250 conduit
251 conduit
252 valve
253 conduit
254 microprocessor
255 motor drive
257 wire
258 wire
259 motor
260 wire
268 sensor
269 sensor
270 sensor
271 sensor
272 sensor
275 bellows
276 bellows
277 bellows
278 crank shaft
279 connecting rods
280 connecting rods
281 connecting rods
282 pump inlets
283 pump inlets
284 pump inlets
285 outlets
286 outlets
287 outlets
300 sensor
301 line
302 conduit
310 controller

What is claimed is:

1. A rack and a tank apparatus for processing photosensitive materials, in which processing solution flows through a rack and a tank, the rack and the tank are relatively dimensioned so that a volume for holding and moving processing solution and photosensitive material is formed, said apparatus characterized by:

means for replenishing the processing solution in precisely controlled amounts of a replenishing solution to be delivered is determined prior to actual delivery so that the replenishing solution provided is consistent with the required amount needed.

2. The apparatus claimed in claim 1, wherein said replenishing means comprises:

one or more pumps that output a uniform amount of replenishing solution.

3. The apparatus claimed in claim 1, wherein said replenishing means comprises:

two or more pumps that are connected out of phase.

4. The apparatus claimed in claim 3, wherein said pumps are selected from the group consisting of bellows pumps, piston pumps and peristaltic pumps.

5. The apparatus claimed in claim 1, wherein said replenishing means comprises:

a pump that has a uniform delivery output that is controlled by adjusting the input cycle of said pump.

6. The apparatus claimed in claim 1, further including:

calibration means coupled to said replenishing means for charging and verifying the rate of deliver of replenishing solution.

7. The apparatus claimed in claim 6, wherein said calibration means comprises:

a metering vessel for receiving said processing solution; and delivery means for delivering replenishing solution to said metering vessel.

8. The apparatus claimed in claim 7, further including:

a microprocessor coupled to said metering vessel to automatically measure the rate of delivery of replenishing solution.

9. The apparatus claimed in claim 7, further including:

a microprocessor coupled to said metering vessel and said replenishing means to automatically adjust and control the rate of delivery of said replenishing solution.

10. The apparatus claimed in claim 1, further including:

calibration means coupled to said replenishing means for verifying and controlling the rate of delivery of said replenishing solution, while the processing apparatus is processing photosensitive materials.

11. The apparatus claimed in claim 1, further including:

calibration means coupled to said replenishing means for automatically verifying and changing the rate of delivery of said replenishing solution, while the processing apparatus is processing photosensitive materials.

12. An apparatus for processing photosensitive materials having a low volume processing chamber for holding a processing solution through which a photosensitive material is passed, said apparatus characterized by:

means for replenishing the processing solution in said processing chamber with a replenishing solution so that the replenishing solution is provided in a smooth non-pulsing manner.

13. An apparatus according to claim 12 wherein the replenishing means comprises a bellows pump with a 360° rotation.

14. An apparatus according to claim 12 wherein the replenishing means comprises at least two bellows pumps that are connected so that their outputs are out of phase with respect to each other.

15. An apparatus according to claim 12 further comprising a recirculation path for removing a portion of the processing solution from said chamber at a first point and delivering and returning the processing solution to the tank at a second point, said recirculation path including a manifold whereby said replenishing solution is introduced to the processing solutions.

16. An apparatus for processing photosensitive material having a low volume processing chamber for holding the processing solution through which a photosensitive material is passed, said apparatus characterized by:

means for replenishing processing solution in said processing chamber with a replenishing solution, said means for replenishing a processing solution comprising a delivering means for delivery of the replenishing solution from a holding tank;

calibration means for monitoring and modifying rate of delivery of a replenishing solution by said delivering means, said calibration means comprising means for measuring the amount of replenishing solution that is to be delivered by said delivery means, means for returning the replenishing solution from said means for measuring the amount of fluid back to said holding tank; and means for recalibrating the rate at which said delivery means supplies replenishing solution.

17. An apparatus for processing photosensitive materials having a low volume processing chamber for holding the processing solution through which a photosensitive material is passed, said apparatus characterized by:

means for replenishing the processing solution in said processing chamber with a replenishing solution;

calibration means for monitoring and modifying the rate of delivery of the replenishing solution to the processing chamber, said calibration means comprising a metering vessel of a predetermined volume and sensing means for sensing the rate of flow of replenishing solution through the metering vessel.

18. A method of providing a replenishing solution to the processing solution of an apparatus having a low volume processing chamber containing a processing solution for processing a photosensitive material, comprising the steps of:

a. providing a metering vessel of a predetermined volume through which the replenishing solution must pass;

b. introducing the replenishing solution from a reservoir through said metering vessel to said processing chamber;

c. sensing the rate of flow of the replenishing solution through the metering vessel;

d. determining the amount of replenishing solution supplied in response to the rate of flow of the replenishing solution passing through said metering vessel; and e. adjusting the rate of flow of the replenishing solution to correspond to the amount of replenishing solution required prior to delivery to the processing solution.

19. A method according to claim 18 further comprising the steps of:

monitoring the amount of replenishing solution required to be added to the said processing chamber in response to the amount of photosensitive material being processed.

* * * * *